US008574663B2

(12) United States Patent
Tavkhelidze et al.

(10) Patent No.: US 8,574,663 B2
(45) Date of Patent: Nov. 5, 2013

(54) SURFACE PAIRS

(75) Inventors: Avto Tavkhelidze, Tbilisi (GE); Misha Vepkhvadze, Tbilisi (GE)

(73) Assignee: Borealis Technical Limited (GI)

( * ) Notice: Subject to any disclaimer, the term of this patent is extended or adjusted under 35 U.S.C. 154(b) by 1244 days.

(21) Appl. No.: 11/667,882

(22) PCT Filed: Nov. 17, 2005

(86) PCT No.: PCT/US2005/042093

§ 371 (c)(1),
(2), (4) Date: May 15, 2007

(87) PCT Pub. No.: WO2006/055890

PCT Pub. Date: May 26, 2006

(65) Prior Publication Data

US 2008/0003415 A1 Jan. 3, 2008

Related U.S. Application Data

(60) Continuation-in-part of application No. 10/991,257, filed on Nov. 16, 2004, now abandoned, which is a continuation-in-part of application No. 10/508,914, filed as application No. PCT/US03/08907 on Mar. 24, 2003, now Pat. No. 7,074,498, application No. 11/667,882, which is a continuation-in-part of application No. 10/760,697, filed on Jan. 19, 2004, now Pat. No. 7,166,786, which is a division of application No. 09/634,615, filed on Aug. 5, 2000, now Pat. No. 6,680,214, and a continuation of application No. 09/093,652, filed on Jun. 8, 1998, now abandoned.

(60) Provisional application No. 60/149,805, filed on Aug. 18, 1999, provisional application No. 60/373,508, filed on Apr. 17, 2002, provisional application No. 60/366,563, filed on Mar. 22, 2002, provisional application No. 60/366,564, filed on Mar. 22, 2002.

(51) Int. Cl.
*B05D 5/12* (2006.01)

(52) U.S. Cl.
USPC ..... 427/97.2; 427/97.3; 427/97.7; 427/98.8; 427/99.3

(58) Field of Classification Search
USPC ..... 427/97.7, 98.8, 97.2, 99.3
See application file for complete search history.

(56) References Cited

U.S. PATENT DOCUMENTS 3,740,592 A 6/1973 Engdahl et al.
4,011,582 A 3/1977 Cline et al.

(Continued)

FOREIGN PATENT DOCUMENTS

DE 3404137 A1 8/1985
DE 3818192 A1 12/1989

(Continued)

OTHER PUBLICATIONS

Chou et al., "Imprint Lithography with 25 Nanometer Resolution", Science, Apr. 5, 1996, pp. 85-87, vol. 272.

(Continued)

*Primary Examiner* — Brian K Talbot

(57) ABSTRACT

The present invention is a method for fabricating an electrode pair precursor which comprises the steps of creating on one surface of a substrate one or more indents of a depth less than approximately 10 nm and a width less than approximately 1 μm; depositing a layer of material on the top of this structured substrate to forming a first electrode precursor; depositing another layer the first electrode precursor to form a second electrode precursor; and finally forming a third layer on top of the second electrode precursor.

13 Claims, 4 Drawing Sheets

(56) References Cited

U.S. PATENT DOCUMENTS

| | | | | | |
|---|---|---|---|---|---|
| 4,039,352 | A | | 8/1977 | Marinescu | |
| 4,063,965 | A | | 12/1977 | Cline et al. | |
| 4,686,162 | A | | 8/1987 | Stangl et al. | |
| 5,023,671 | A | | 6/1991 | DiVincenzo et al. | |
| 5,068,535 | A | | 11/1991 | Rabalais | |
| 5,091,339 | A | * | 2/1992 | Carey | 216/18 |
| 5,119,151 | A | | 6/1992 | Onda | |
| 5,229,320 | A | | 7/1993 | Ugajin | |
| 5,233,205 | A | | 8/1993 | Usagawa et al. | |
| 5,247,223 | A | | 9/1993 | Mori et al. | |
| 5,332,952 | A | | 7/1994 | Ugajin et al. | |
| 5,336,547 | A | | 8/1994 | Kawakita et al. | |
| 5,371,388 | A | | 12/1994 | Oda | |
| 5,432,362 | A | | 7/1995 | Lippens et al. | |
| 5,503,963 | A | | 4/1996 | Bifano | |
| 5,521,735 | A | | 5/1996 | Shimizu et al. | |
| 5,579,232 | A | | 11/1996 | Tong et al. | |
| 5,604,357 | A | | 2/1997 | Hori | |
| 5,654,557 | A | | 8/1997 | Taneya et al. | |
| 5,675,972 | A | | 10/1997 | Edelson | |
| 5,699,668 | A | | 12/1997 | Cox | |
| 5,705,321 | A | | 1/1998 | Brueck et al. | |
| 5,719,407 | A | | 2/1998 | Ugajin | |
| 5,722,242 | A | | 3/1998 | Edelson | |
| 5,772,905 | A | * | 6/1998 | Chou | 216/44 |
| 5,917,156 | A | | 6/1999 | Nobori et al. | |
| 6,117,344 | A | * | 9/2000 | Cox et al. | 216/11 |
| 6,214,651 | B1 | | 4/2001 | Cox | |
| 6,225,205 | B1 | | 5/2001 | Kinoshita | |
| 6,281,514 | B1 | | 8/2001 | Tavkhelidze | |
| 6,309,580 | B1 | | 10/2001 | Chou | |
| 6,417,060 | B2 | | 7/2002 | Tavkhelidze et al. | |
| 6,495,843 | B1 | | 12/2002 | Tavkhelidze et al. | |
| 6,531,703 | B1 | | 3/2003 | Tavkhelidze et al. | |
| 6,680,214 | B1 | | 1/2004 | Tavkhelidze et al. | |
| 7,074,498 | B2 | * | 7/2006 | Tavkhelidze et al. | 428/687 |
| 7,140,102 | B2 | * | 11/2006 | Taliashvili et al. | 29/842 |
| 7,658,772 | B2 | * | 2/2010 | Tavkhelidze et al. | 29/25.02 |
| 2001/0046749 | A1 | | 11/2001 | Tavkhelidze et al. | |
| 2003/0068431 | A1 | | 4/2003 | Taliashvili et al. | |
| 2003/0221608 | A1 | | 12/2003 | Mori | |
| 2004/0126547 | A1 | * | 7/2004 | Coomer | 428/209 |
| 2004/0174596 | A1 | | 9/2004 | Umeki | |

FOREIGN PATENT DOCUMENTS

| | | | | |
|---|---|---|---|---|
| EP | 0 437 654 | A1 | | 7/1991 |
| JP | 03155376 | A | | 7/1991 |
| JP | 4080964 | A | | 3/1992 |
| JP | 05226704 | A | | 9/1993 |
| JP | 2001-352147 | | * | 12/2001 |
| WO | WO 99/13562 | A1 | | 3/1999 |
| WO | WO 99/64642 | A | | 12/1999 |
| WO | WO 00/59047 | A | | 10/2000 |
| WO | WO 02/47178 | A | | 6/2002 |
| WO | WO03/083177 | | | 10/2003 |

OTHER PUBLICATIONS

Sungtaek Ju et al., "Study of interface effects in thermoelectric microfefrigerators", Journal of Applied Physics, Oct. 1, 2000, pp. 4135-4139, vol. 88, No. 7.

Hishinuma et al., "Refrigeration by combined tunneling and thermionic emmission in vacuum: Use of nanometer scale design", Appl Phys Lett, Apr. 23, 2001, pp. 2572-2574,vol. 78,No. 17.

Lebreton C et al: "Nanofabrication on gold surface with scanning tunneling microscopy" Microelectronic Engineering, Jan. 1996, pp. 391-394, vol. 30, No. 1-4.

Grundmeier G et al: "Interfacial processes during plasma polymer deposition on oxide covered iron" Preparation and Characterization, Sep. 8, 1999, pp. 119-127, vol. 352, No. 1-2.

Kirchoefer S W et al: "Barium-strontium-titanate thin films for application in radio-frequency-microelectromechanical" Appl Phys Lett, Feb. 18, 2002, pp. 1255-1257, vol. 80, No. 7.

Suzuki Y et al: "Magnetic domains of cobalt ultrathin films observed with a scanning tunneling microscope using . . . " Appl Phys Lett, Nov. 24, 1997, pp. 3153-3155, vol. 71, No. 21.

Leon N. Cooper, "Bound Electron Pairs in Degenerate Fermi Gas", Physical Review, Nov. 15, 1956, pp. 1189-1190, vol. 104, No. 4.

Bardeen et al., "Theory of Superconductivity", Physical Review, Dec. 1, 1957, pp. 1175-1204, vol. 108, No. 5.

* cited by examiner

SURFACE PAIRS

CROSS-REFERENCE TO RELATED APPLICATIONS

This application is the U.S. national stage application of International Application No. PCT/US2005/042093, filed Nov. 17, 2005, which international application was published on May 26, 2006, as International Publication WO/2006/055890 in the English language. The International Application claims the benefit of UK Patent Application No. 0425260.7, filed Nov. 17, 2004. This application is a Continuation in part of U.S. patent application Ser. No. 10/991,257 filed Nov. 16, 2004, which is a continuation-in-part application of application Ser. No. 10/508,914 filed Sep. 22, 2004, which is a U.S. national stage application of International Application PCT/US03/08907, filed Mar. 24, 2003, which international application was published on Oct. 9, 2003, as International Publication WO03083177 in the English language. The International Application claims the benefit of U.S. Provisional Application No. 60/366,563, filed Mar. 22, 2002, U.S. Provisional Application No. 60/366,564, filed Mar. 22, 2002, and U.S. Provisional Application No. 60/373,508, filed Apr. 17, 2002. This application is also a continuation-in-part application of application Ser. No. 10/760,697 filed Jan. 19, 2004 which is a divisional application of application Ser. No. 09/634,615, filed Aug. 5, 2000, now U.S. Pat. No. 6,680,214, which claims the benefit of U.S. Provisional Application No. 60/149,805, filed on Aug. 18, 1999, and is a continuation application of application Ser. No. 09/093,652, filed Jun. 8, 1998, now abandoned, and is related to application Ser. No. 09/020,654, filed Feb. 9, 1998, now U.S. Pat. No. 6,281,514. The above-mentioned patent applications are assigned to the assignee of the present application and are herein incorporated in their entirety by reference.

FIELD OF INVENTION

The present invention relates to methods for making electrode pairs in which the distribution of energy states within them is altered and for promoting the transfer of elementary particles across a potential energy barrier.

BACKGROUND OF THE INVENTION

U.S. Pat. No. 6,281,514, U.S. Pat. No. 6,117,344, U.S. Pat. No. 6,531,703 and U.S. Pat. No. 6,495,843 disclose a method for promoting the passage of elementary particles at or through a potential barrier comprising providing a potential barrier having a geometrical shape for causing de Broglie interference between said elementary particles is disclosed. Also disclosed is an elementary particle-emitting surface having a series of indents. The depth of the indents is chosen so that the probability wave of the elementary particle reflected from the bottom of the indent interferes destructively with the probability wave of the elementary particle reflected from the surface. This results in the increase of tunnelling through the potential barrier. When the elementary particle is an electron, and potential barrier is surface of the substance electrons tunnel through the potential barrier, thereby leading to a reduction in the effective work function of the surface.

WO03083177 discloses modification of a metal surface with patterned indents that increases the Fermi energy level inside the metal, leading to a decrease in electron work function. Also disclosed is a method for making nanostructured surfaces having perpendicular features with sharp edges.

DISCLOSURE OF INVENTION

The present invention is a method for fabricating an electrode pair precursor which comprises the steps of creating on one surface of a substrate one or more indents of a depth less than 10 nm and a width less than 1 μm; depositing a layer of material on the top of this structured substrate to forming a first electrode precursor; depositing another layer the first electrode precursor to form a second electrode precursor; and finally forming a third layer on top of the second electrode precursor.

In a further embodiment the method additionally comprises creating on the surface of the second electrode precursor one or more indents of a depth less than 10 nm and a width less than 1 μm.

In a further embodiment the method additionally comprises the deposition of a another layer between said first and second electrode precursor layers.

The present invention is also directed towards an electrode pair precursor comprising a substrate having on one surface one or more indents of a depth less than 10 nm and a width less than 1 μm; having a layer of material formed on the top of this structured substrate to form a first electrode precursor; having another layer formed on the first electrode precursor to form a second electrode precursor; and finally having a third layer formed on top of the second electrode precursor.

In a further embodiment the electrode pair precursor has on the surface of the second electrode precursor one or more indents of a depth less than 10 nm and a width less than 1 μm.

In a further embodiment the electrode pair precursor additionally comprises another layer between said first and second electrode precursor layers.

BRIEF DESCRIPTION OF DRAWINGS

For a more complete explanation of the present invention and the technical advantages thereof, reference is now made to the following description and the accompanying drawing in which.

BEST MODE FOR CARRYING OUT THE INVENTION

Figure 1:
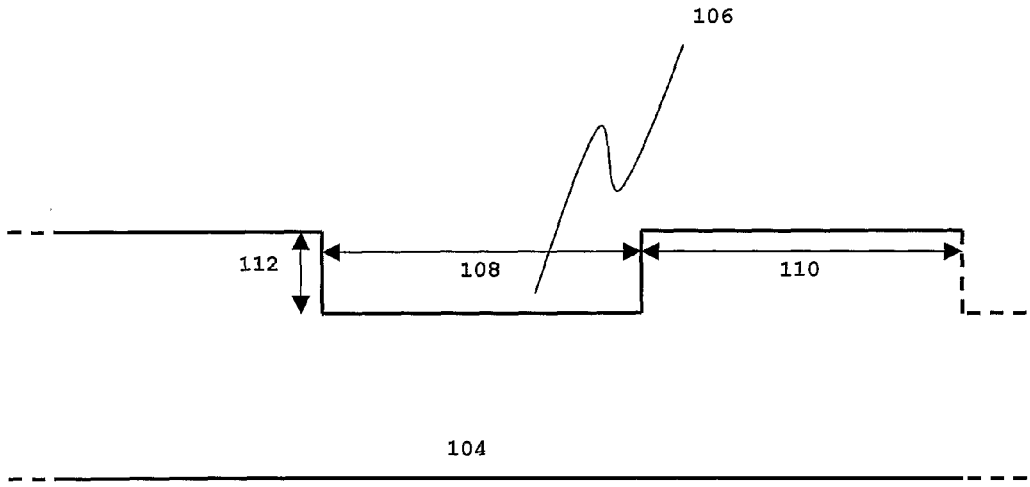
FIG. 1 shows the shape and dimensions of a surface structure utilised in the present invention.

Embodiments of the present invention and their technical advantages may be better understood by referring to FIG. 1 which shows a substrate 104. The substrate has an indent 106 on one surface. Whilst the structure shown in FIG. 1 is a single indented region, this should not be considered to limit the scope of the invention, and dotted lines have been drawn to indicate that in further embodiments the structure shown may be extended in one or both directions (i.e. to the left and/or to the right) to form features on the surface of the substrate that have a repeating, or periodic, nature.

The configuration of the surface may resemble a corrugated pattern of squared-off, "u"-shaped ridges and/or valleys. Alternatively, the pattern may be a regular pattern of rectangular "plateaus" or "holes," where the pattern resembles a checkerboard. The walls of said indents should be substantially perpendicular to one another, and the edges of the indents should be substantially sharp. Further, one of ordinary skill in the art will recognize that other configurations are possible which may produce the desired interference of wave probability functions. The surface configuration may be achieved using conventional approaches known in the art, including without limitation lithography and e-beam milling.

Indent 106 has a width 108 and a depth 112 and the separation between the indents is 110. Preferably distances 108 and 110 are substantially equal. Preferably distance 108 is of the order of 1 μm or less. Utilization of e-beam lithography to create structures of the kind shown in FIG. 1 may allow indents to be formed in which distance 108 is 1 μm or less. Distance 112 is of the order of 10 nm or less, and is preferably of the order of 5 nm.

Figure 2:
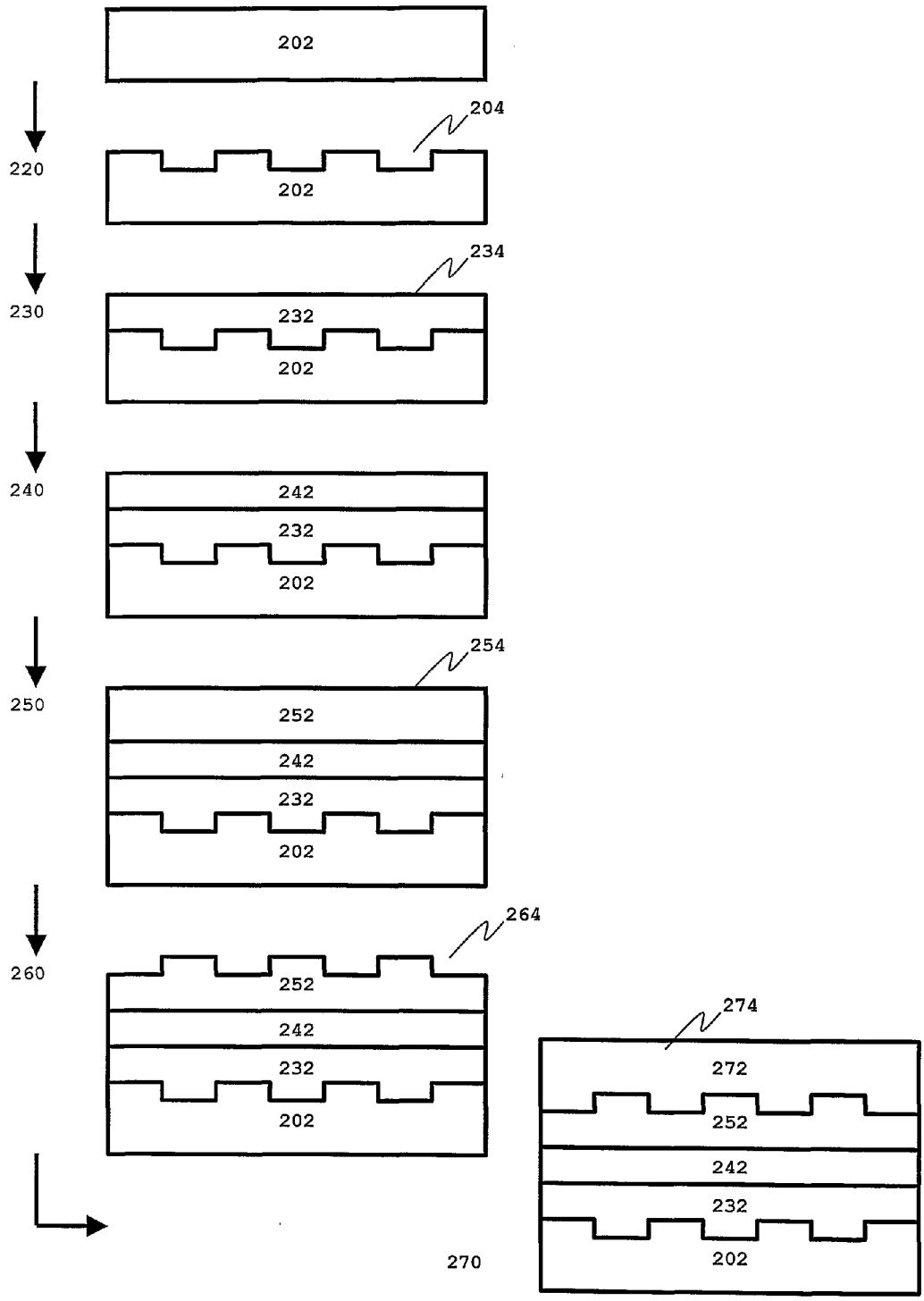
FIGS. 2 and 3 show in a diagrammatic form processes for making the electrode pair precursors of the present invention.

Referring now to FIG. 2, which shows in a diagrammatic form a process for making a pair of electrodes for use in a thermionic device, in a step 220 a surface of substrate 202 is modified to form a series of indents or channels 204 across the substrate. Substrate 202 may be for example and without limitation any substrate conventionally used in microelectronic or thermionic applications. Substrate 202 is preferably silica or silicon, which may optionally be doped to increase thermal or electrical conductivity. The indents or channels are formed for example and without limitation by any approach conventionally used in microelectronic applications, including stamping, milling, photolithography, e-beam lithography and ion-beam lithography. The dimensions of the indents are chosen to cause wave interference in a material, as disclosed above.

In a step 230, a layer of first material 232 is formed on the substrate in such a way that the indented regions are filled and so that the surface of the layer of a first material opposing said indented region 234 is substantially flat. Material 232 may be any material in which the Fermi level can be shifted using wave properties of electrons in material having a periodic structured surface. The first layer may be substantially homogeneous or substantially free of granular irregularities. Preferably the material is one that, under stable conditions, will not form an oxide layer, or will form an oxide layer of a known and reliable thickness. Preferred materials include, but are not restricted to, metals such as gold and chrome, and materials that under stable conditions form an oxide layer preferably of less than about ten nanometers, and more preferably of less than about five nanometers. We suggest that using gold as the material, may allow the apparent work function to be reduced to as little as 1 eV, and using calcium may allow an apparent work function as little as 0.2 eV.

Figure 3:
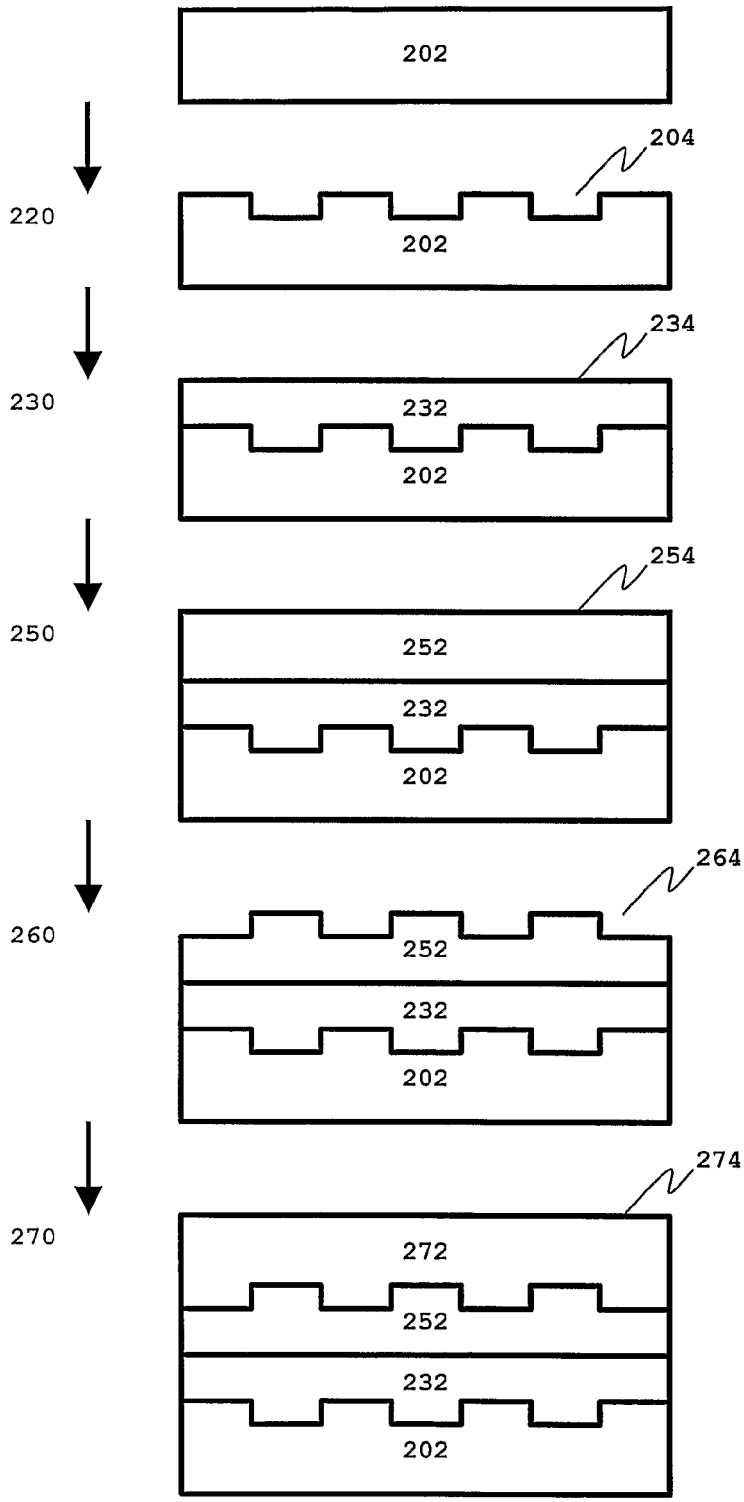

In a step 240, a layer of second material 242 is formed on the substantially flat surface 234 of layer 232. Preferably material 242 is silver, but may be any material whose adhesion to material 232 may be carefully controlled. Layer 242 is sufficiently thin that the structure of layer 232 is maintained on its surface. Step 240 is optional, and may be omitted, as is shown In FIG. 3.

In a step 250, a layer of third material 252 is formed on layer 242. Material 232 may be any material in which the Fermi level can be shifted by altering the wave behavior of electrons in a material having a periodic structured surface. Preferably the material is one that, under stable conditions, will not form an oxide layer, or will form an oxide layer of a known and reliable thickness. Preferred materials include, but are not restricted to, metals such as gold and chrome, and materials that under stable conditions form an oxide layer preferably of less than about ten nanometers, and more preferably of less than about five nanometers. We suggest that using gold as the material, may allow the apparent work function to be reduced to as little as 1 eV, and using calcium may allow an apparent work function as little as 0.2 eV. If step 240 has been omitted, as shown in FIG. 3, then conditions used for step 250 are controlled so that adhesion to material 232 may be carefully controlled In a step 260, a surface of said third material is modified to form a series of indents or channels 254 across said surface. The indents or channels are formed for example and without limitation by any approach conventionally used in microelectronic applications, including stamping, milling, photolithography, e-beam lithography and ion-beam lithography. The dimensions of the indents are chosen to cause wave interference in a material, as disclosed above.

In a step 270, fourth material 272 is formed on the third material in such a way that the indented regions are filled and so that the surface of the layer of a fourth material opposing said indented region 274 is substantially flat. This yields a composite. Preferably material 272 is copper, and is formed by an electrochemical process.

As disclosed above, conditions for forming layers 232, 242 and 252 are carefully chosen so that the adhesion between the layers may be controlled. Where step 240 is omitted, as in FIG. 3, then conditions for forming layers 232 and 252 are carefully chosen so that the adhesion between the layers may be controlled.

The composite formed from the steps above may be mounted in a suitable housing that permits the composite to be opened in a controlled environment. Such a housing is disclosed in WO03/090245, which is incorporated herein by reference in its entirety. The housing may include a getter, either for oxygen or water vapour. The housing may also include positioning means to control the separation of the two parts of the split composite. Preferably the electrodes will be positioned approximately 0.5 μm apart to overcome space charge effects.

The housing may also include thermal pathway elements that allow a heat source to be contacted to one half of the composite, and a heat sink to be contacted to the other. The housing may also include electrical connections to allow a voltage to be applied across the pair of electrodes, or to allow a current flowing between the electrodes to be applied to an external load.

Figure 4A:
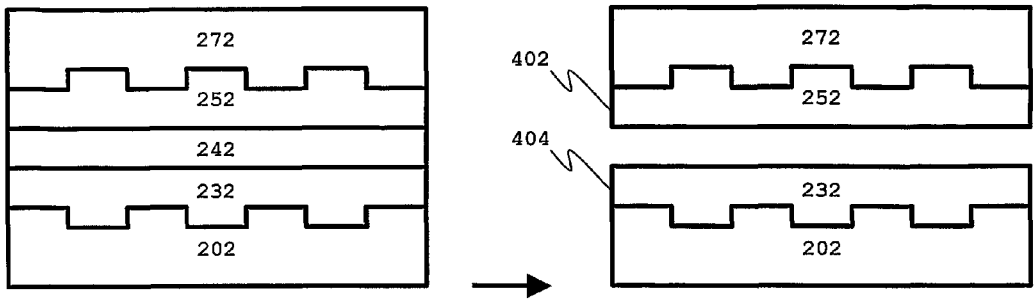
FIGS. 4*a* and 4*b* show how the electrode pair precursors may be split to create electrode pairs.
Figure 4B:
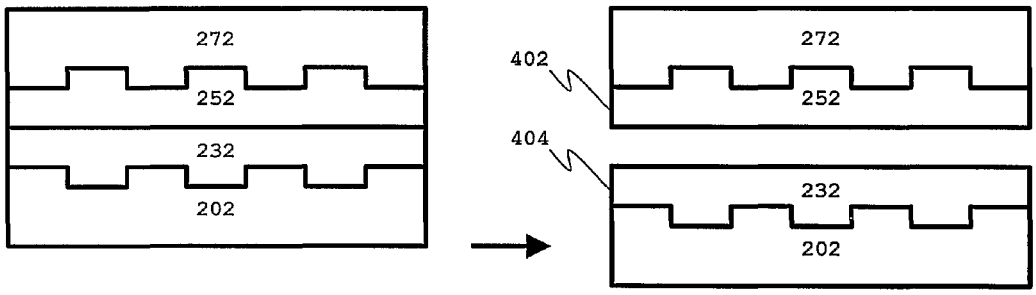

Referring now to FIG. 4*a*, the composite formed as a result of the process disclosed above and shown in FIG. 2, is separated and layer 242 is removed to yield a pair of electrodes as shown. FIG. 4*b* illustrates this separation step for a composite formed as a result of the process disclosed above and shown in FIG. 3. The separation may be achieved using any of the methods disclosed in WO03/021663 which is incorporated herein by reference in its entirety, and is preferably a thermal treatment step, which introduces tension sufficiently strong to overcome adhesion between the layers. As a result of this step, any minor imperfections on the surface of electrode 402 are matched on electrode 404.

Figure 4C:
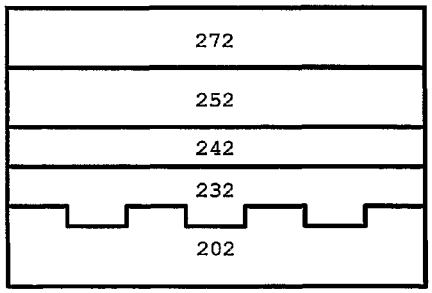
FIGS. 4*c* and 4*d* show electrode pair precursors in which only one of the electrode precursors has a structured undersurface.
Figure 4D:
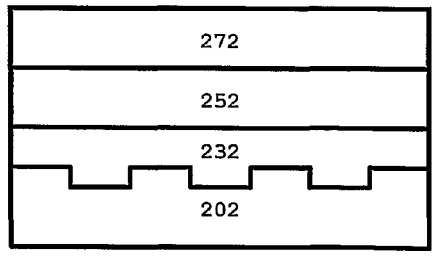

In a further embodiment, step 260 is omitted, which leads to a composite having only one modified layer, as shown in FIGS. 4*c* and 4*d*. When these are separated as described above, one electrode has a surface having an indented under surface, whilst the other electrode is of more conventional construction.

The invention claimed is:

1. A method of fabricating an electrode pair precursor comprising the steps:

a. providing a substrate suitable for forming an electrode pair precursor useful in microelectronic or thermionic applications comprising undoped or doped silica or silicon;

b. modifying a surface of said substrate to form a regular repeating pattern of a series of substantially equally spaced indents with substantially perpendicular walls and substantially sharp edges having dimensions selected to cause interference of wave probability functions and reduce work function of an electron passing through said indents, wherein a spaced distance between indents and a width dimension of said indents are substantially equal and comprise a distance on the order of about 1 micrometer (μm), and a depth of said indents comprises a distance on the order of about 10 nanometers (nm) or less;

c. forming a first layer of a first material to cover said modified surface of said substrate so that said repeating pattern of spaced indents is filled and a surface of said first layer opposite said filled indents is substantially planar, wherein said first material comprises a material in which Fermi level can be shifted using wave properties of electrons in material having a periodic structured surface to allow reduction of apparent work function;

d. forming a second layer of a second material to cover said planar surface of said first layer, wherein said second material is selected so that the adhesion of said second material to said first material can be carefully controlled and said second layer has a planar surface in contact with said first layer planar surface and an opposed planar surface;

e. forming a third layer of a third material to cover said second layer opposed planar surface, wherein said third material is selected to have a Fermi level that can be shifted using wave properties of electrons in material having a periodic structured surface to allow reduction of apparent work function;

f. modifying a surface of said third layer opposite said second layer opposed planar surface to form a regular repeating pattern of a series of substantially equally spaced indents having a configuration and dimensions substantially identical to the indents formed in said substrate; and g. forming a fourth layer to cover the modified third layer surface so that the regular repeating pattern of spaced indents in said third layer is filled and a substantially planar surface is formed on said fourth layer opposite the indents in the third layer to produce a composite electrode pair precursor, wherein said composite electrode pair precursor can be separated and said second material removed to form a pair of electrodes.

2. The method of claim 1, wherein said substrate is a monocrystal.

3. The method of claim 1, wherein said depth of each indent in said regular repeating pattern of said series of substantially equally spaced indents comprises a distance of about 5 nm.

4. The method of claim 1, wherein said width of each of said indents and each said substantially equal spaced distance between said indents in said regular repeating pattern of said series of substantially equally spaced indents comprises a distance on the order of about 0.1 μm.

5. The method of claim 1, wherein said first material comprises a material that, under stable conditions, will form an oxide layer having a known and reliable thickness.

6. The method of claim 5, wherein said first material comprises gold, chrome, or calcium, and, when an oxide layer is formed, said known and reliable thickness is less then about 10 nm, wherein apparent work function is reduced to 1 eV or less.

7. The method of claim 1, wherein said second material comprises silver.

8. The method of claim 1, wherein said third material comprises a material that, under stable conditions, will form an oxide layer having a known and reliable thickness.

9. The method of claim 8, wherein said third material comprises gold, chrome, or calcium, and, when an oxide layer is formed, said known and reliable thickness is less then about 10 nm, wherein apparent work function is reduced to 1 eV or less.

10. The method of claim 1, wherein said fourth material comprises copper.

11. The method of claim 5, wherein said first material and said third material comprise gold, chrome, or calcium, and, when an oxide layer is formed, said known and reliable thickness is less then about 10 nm, wherein apparent work function is reduced to 1 eV or less; said second material comprises silver; and said fourth material comprises copper.

12. The method of claim 1, wherein the step of forming said second layer is omitted and a layer of said third material is formed directly on said planar surface of said first layer, wherein said third material is selected to control adhesion to said first layer.

13. The method of claim 10, wherein the method for forming said fourth layer of copper comprises electrolytic growth of copper.

* * * * *